US006152792A

United States Patent [19]

Lanni et al.

[11] Patent Number: 6,152,792

[45] Date of Patent: Nov. 28, 2000

[54] STEERING AND REVERSING APPARATUS FOR WATERJET PROPULSION SYSTEMS

[75] Inventors: Francesco Lanni, Walpole; Gregory P. Platzer, Wrentham, both of Mass.

[73] Assignee: Bird-Johnson Company, Walpole, Mass.

[21] Appl. No.: 09/265,066

[22] Filed: Mar. 9, 1999

[51] Int. Cl.[7] ..... B63H 11/107

[52] U.S. Cl. ..... 440/40; 440/41

[58] Field of Search ..... 440/38, 40, 41, 440/42

[56] References Cited

U.S. PATENT DOCUMENTS

| | | | |
|---|---|---|---|
| 3,064,420 | 11/1962 | Goehler | 239/265.27 |
| 3,089,454 | 5/1963 | Chronic | 440/41 |
| 3,138,922 | 6/1964 | Englehart et al. | 60/222 |
| 3,143,857 | 8/1964 | Eaton | 60/221 |
| 3,207,116 | 9/1965 | France | 440/41 |
| 3,241,770 | 3/1966 | Reynolds et al. . | |
| 3,266,733 | 8/1966 | Goehler | 239/265.27 |
| 3,756,185 | 9/1973 | Breslin | 440/41 |
| 3,807,346 | 4/1974 | Delfeld . | |
| 3,901,176 | 8/1975 | Copp et al. | 440/42 |
| 4,026,235 | 5/1977 | Woodfill . | |
| 4,315,749 | 2/1982 | Baker et al. . | |
| 4,895,093 | 1/1990 | Dalsbö . | |
| 5,240,443 | 8/1993 | Futaki . | |
| 5,376,028 | 12/1994 | Koyanagi . | |
| 5,401,197 | 3/1995 | Kobayashi . | |
| 5,421,753 | 6/1995 | Roos . | |
| 5,520,133 | 5/1996 | Wiegert . | |
| 5,536,187 | 7/1996 | Nanami . | |
| 5,752,864 | 5/1998 | Jones et al. | 440/41 |

OTHER PUBLICATIONS

Chen, Benjamin Y–H, "Integrated Ducted Propulsor Concept," SNAME Symposium at Virginia Beach, Virginia, Sep. 17–18, 1991, pp. 19–1 to 19–10.

Dai, Charles, "Development of a Vertical Motor Propulsor," SNAME Symposium at Virginia Beach, Virginia, Sep. 23–24, 1997, pp. 1 to 19.

*Primary Examiner*—S. Joseph Morano
*Assistant Examiner*—Ajay Vasudeva
*Attorney, Agent, or Firm*—Baker Botts L.L.P.

[57] ABSTRACT

A waterjet steering and reversing apparatus has a steering nozzle mounted aft of the exit nozzle for pivotal movement about a steering pivot axis that lies in a vertical plane and a reversing deflector that is mounted for pivotal movement about a reversing pivot axis for movement between an inactive position clear of a water jet discharged from the steering nozzle and an operative position in which the water jet impinges on a surface that deflects the water jet to a direction having a forward vector. The reversing pivot axis is perpendicular to the vertical plane and spaced apart from the steering pivot axis. A rotatable steering shaft is coupled at its lower end to the steering nozzle, is coaxial with the steering pivot axis, extends upwardly through an opening in the hull, and has an upper end portion located within the hull. A hollow reversing shaft received telescopically over a portion of the steering shaft is translatable axially relative to the steering shaft. A steering actuator received within the vessel hull and coupled to the steering shaft imparts rotation to the steering shaft. A mechanical linkage coupled between the reversing shaft and the reversing deflector pivots the reversing deflector between the inactive position and the operative position upon axial translation of the reversing shaft relative to the steering shaft by a reversing actuator received within the hull.

9 Claims, 11 Drawing Sheets

STEERING AND REVERSING APPARATUS FOR WATERJET PROPULSION SYSTEMS

BACKGROUND OF THE INVENTION

Generally, the pump of a waterjet propulsion system for a surface vessel is mounted in an opening in the transom of the vessel. Steering is provided by a steering nozzle that is mounted for pivotal movement about a substantially vertical axis in a position immediately aft of the discharge nozzle of the waterjet pump and is pivoted, usually by one or more hydraulic piston/cylinders that are coupled between the pump assembly or the transom and the steering nozzle. Upon actuation, the cylinder(s) pivots the steering nozzle to a selected position oblique to the axial such that the nozzle deflects the water jet to a direction having a lateral vector. The water jet is reversed by a reversing deflector that is normally positioned out of the path of the water jet for ahead propulsion but is moved, usually by a hydraulic piston/cylinder actuator, into the path of the water jet. Generally, the reversing deflector pivots about a horizontal transverse axis from an inactive position above or below the steering nozzle. The reversing deflector is shaped to turn the water jet to a forward direction.

The outboard location of the hydraulic piston/cylinders that actuate the steering nozzle and the reversing deflector requires that several hoses pass through openings in the transom, which complicates the construction of the transom and requires seals in each opening. If there is a failure of an actuator or a hose, hydraulic fluid is lost to the environment. The outboard actuator systems for the steering nozzle and the reversing deflector are also not easily repaired when the vessel is at sea.

Another previously known arrangement for actuating the steering nozzle and reversing deflector of a marine waterjet propulsion system, which is described and shown in U.S. Pat. No. 3,807,346, includes concentric shafts that extend vertically downwardly from a portion of the vessel hull that is located above the steering nozzle and reversing deflector, which are pivotally mounted on a bracket for rotation about a common vertical axis that coincides with the axis of the concentric shafts. The lower end of the inner shaft is coupled to the steering nozzle, and the lower end of the outer shaft is coupled to reversing deflector. The inner shaft is driven by a piston/cylinder steering actuator that is located within the vessel hull and is coupled by a steering lever to the upper end of the inner shaft. A piston/cylinder reversing actuator is coupled between the steering lever and the upper end of the outer shaft so as to pivot the reversing deflector relative to the steering nozzle.

The steering/reversing mechanism of U.S. Pat. No. 3,807,346 has the advantages of requiring only a single penetration of the hull of the vessel and of enabling the steering and reversing actuators to be located within the vessel hull, where they are protected from the hostile water environment and can be serviced readily. The rotation of the reversing deflector about a vertical axis is, however, highly disadvantageous, inasmuch as in the retracted position for ahead propulsion, the reversing deflector resides laterally of the steering nozzle where it creates a large drag. In addition, an inactive positioning of the reversing deflector laterally of the steering nozzle requires additional athwart-ship space, which is limited in many waterjet applications.

SUMMARY OF THE INVENTION

An object of the present invention is to provide a waterjet propulsion system in which the actuators for the steering nozzle and the reversing deflector are, as is known per se, located inboard, thus making inspection, maintenance and repair considerably easier than they are with outboard actuator systems. Another object is to make it possible to use various types of actuators that are not feasible or practical in an outboard location. It is also an object to avoid the requirement for numerous openings and seals in the hull, thus simplifying the construction of the hull. It is also desired to ensure that any failure of a system that uses hydraulic components will not leak hydraulic fluid into the water. A further object is to have the reversing deflector mounted for pivotal movement about a horizontal axis so that when it is positioned for ahead propulsion, it lies above and aft of the steering nozzle where it takes up less athwart ship space and produces less drag than it would in a position laterally of the steering nozzle. A further object is to provide actuation of the steering and reversing apparatus through a series of mechanisms generating rotational and translational motions, respectively. It is still another object to provide a steering and reversing apparatus for waterjet propulsion systems that is of relatively simple structure, highly durable, compact in size, and of low weight.

The foregoing objects are attained, in accordance with the present invention, by a waterjet steering and reversing apparatus for a vessel having a waterjet propulsion pump that includes a discharge nozzle having at least an aft portion located outboard of the vessel hull. A steering nozzle is mounted aft of the discharge nozzle for pivotal movement about a steering pivot axis that lies in a substantially vertical plane that includes the axis of the discharge nozzle of the pump. A reversing deflector is mounted for pivotal movement about a reversing pivot axis for movement between an inactive position substantially clear of a water jet discharged from the steering nozzle and an operative position in which the water jet impinges on a surface of the reversing deflector that is configured to reverse the direction of the water jet to a direction having a forward vector. The reversing pivot axis is perpendicular to the vertical plane and spaced apart from the steering pivot axis. A rotatable steering shaft is coupled at its lower end to the steering nozzle, is coaxial with the steering pivot axis, extends upwardly through an opening in the hull, and has an upper end portion located within the hull. A hollow reversing shaft is received telescopically over a portion of the steering shaft and is translatable axially relative to the steering shaft. A steering actuator received within the vessel hull and coupled to the upper end portion of the steering shaft imparts rotation to the steering shaft. A mechanical linkage coupled between the reversing shaft and the reversing deflector pivots the reversing deflector between the inactive position and the operative position in response to axial translation of the reversing shaft produced by a reversing actuator that is coupled between the steering shaft and the reversing shaft so as to translate the reversing shaft axially of the steering shaft.

The telescopically related steering and reversing shafts require only a single penetration of the hull of the vessel and permit the steering and reversing actuators to be located within the hull, thus enabling a wide choice of types of actuators and facilitating maintenance and repair. The couplings of the steering and reversing shafts to the steering nozzle and reversing deflector are entirely mechanical and can be constructed to be very durable and trouble-free. An especially important advantage of the present invention is derived from the mounting of the reversing deflector for pivotal movement about a horizontal axis aft of the steering axis so that the reversing deflector in an inactive position for forward propulsion resides above the steering nozzle, where it is in the "shadow" of a portion of the hull or a hull-mounted pod on which the discharge nozzle of the waterjet pump is installed, thus minimizing drag.

In preferred embodiments, the steering nozzle is pivotally mounted on the discharge nozzle, thus eliminating a separate support bracket and saving space and weight. The steering shaft may have an upper steering shaft part having a lower end portion received telescopically in an upper portion of the reversing shaft and a lower shaft part having an upper portion received telescopically in a lower portion of the reversing shaft, thereby facilitating assembly and disassembly, simplifying sealing requirements, saving weight, and enabling efficient transmission of steering torque loads.

The reversing deflector may be pivotally mounted on the steering nozzle so that it rotates about the steering axis with the steering nozzle. In that arrangement the reversing shaft and the steering shaft are coupled to rotate conjointly.

An alternative embodiment provides for a reversing axis fixed on a stationary structure such as a waterjet pump or vessel transom and not rotatable with the steering nozzle. In this embodiment, the reversing deflector can be provided with a shape to enable reversing port or starboard.

The mechanical linkage between the reversing shaft may include a Scott-Rouselle mechanism coupled to the reversing shaft and having a pivot output and a reversed crank-slider mechanism coupled to the reversing deflector and a pivot input coupled to the pivot output of the Scott-Rouselle mechanism. Such mechanisms are, preferably, provided in pairs that are located and constructed symmetrically with respect to the vertical plane the includes the axis of the pump discharge nozzle.

As mentioned above, the inboard location permits various types of actuators for steering and reversing to be used. Suitable actuators include hydraulic piston/cylinders (rams), electric motors/reducing gear transmissions, and ballscrew drives. In the case of the steering actuator, a vane-type rotary hydraulic actuators is preferred for its compact size, low weight, and reasonable cost. Advantageously, again for size, weight and cost advantages, an annular piston/cylinder ram is preferred for the reversing actuator.

DESCRIPTION OF THE DRAWINGS

For a more complete understanding of the present invention, and the advantages thereof, reference may be made to the following written description of exemplary embodiments, taken in conjunction with the accompanying drawings.

Figure 1:
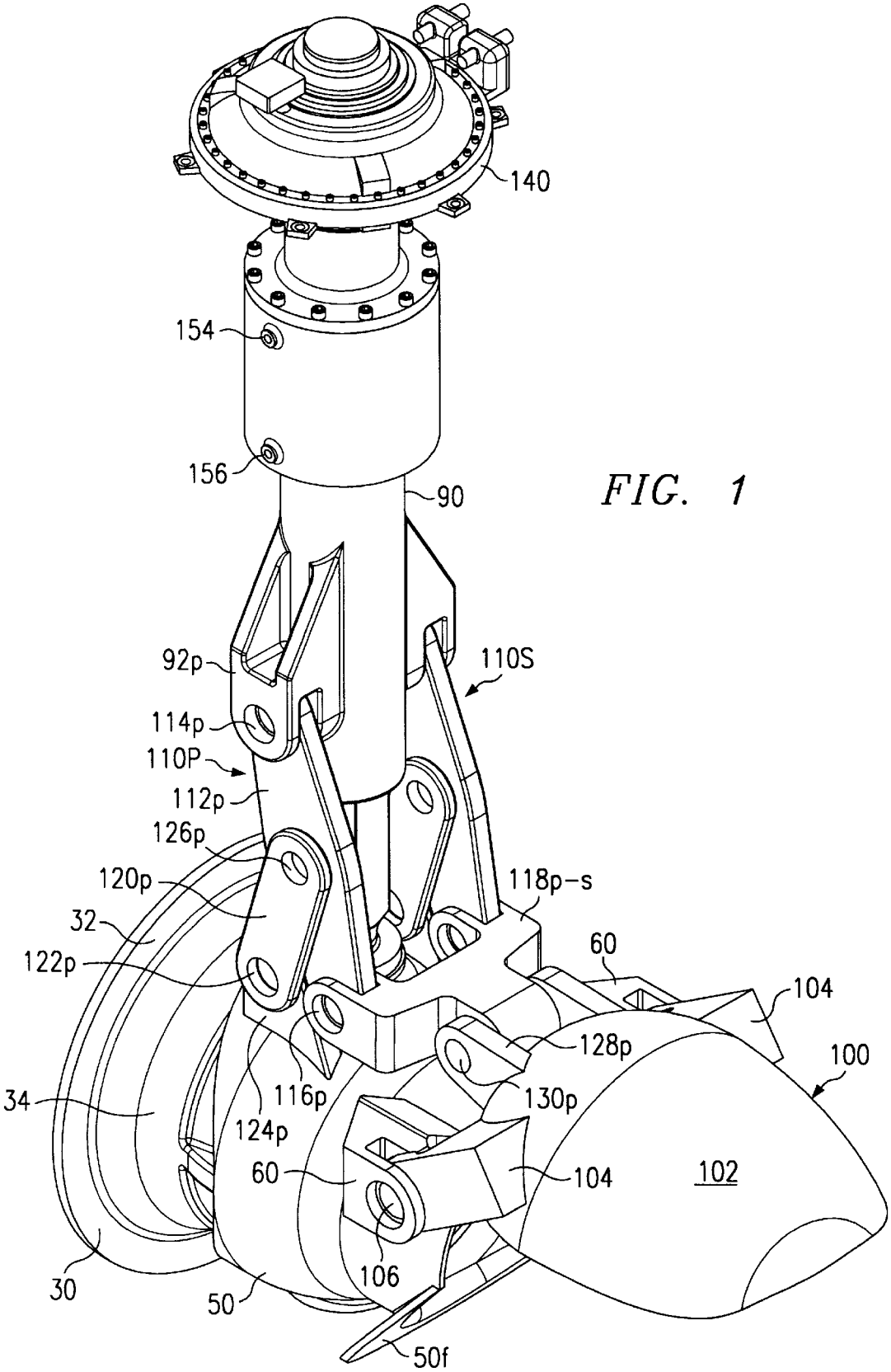
FIG. 1 is a port side three-quarter pictorial view of a first embodiment, which is taken from a vantage point above and aftward and shows the first embodiment in straight ahead operation.
Figure 2:
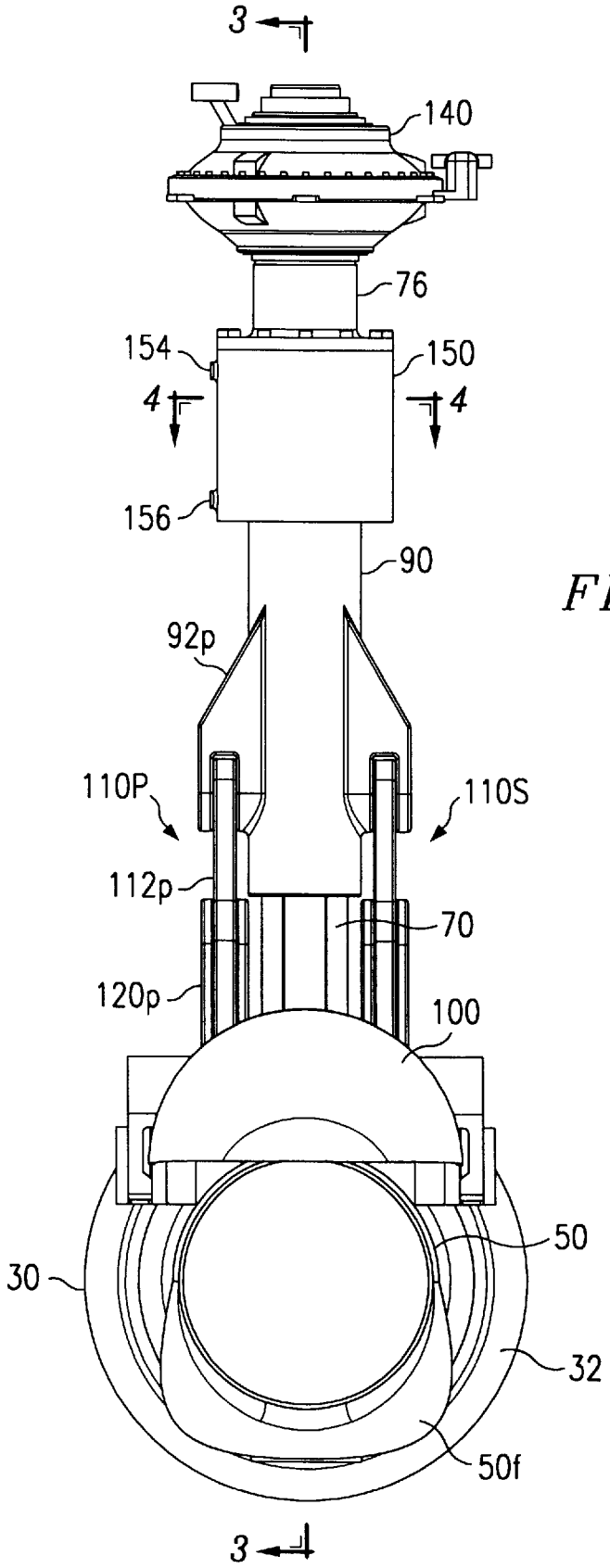
FIG. 2 is rear elevational view of the first embodiment, also showing it set for straight ahead propulsion.
Figure 3:
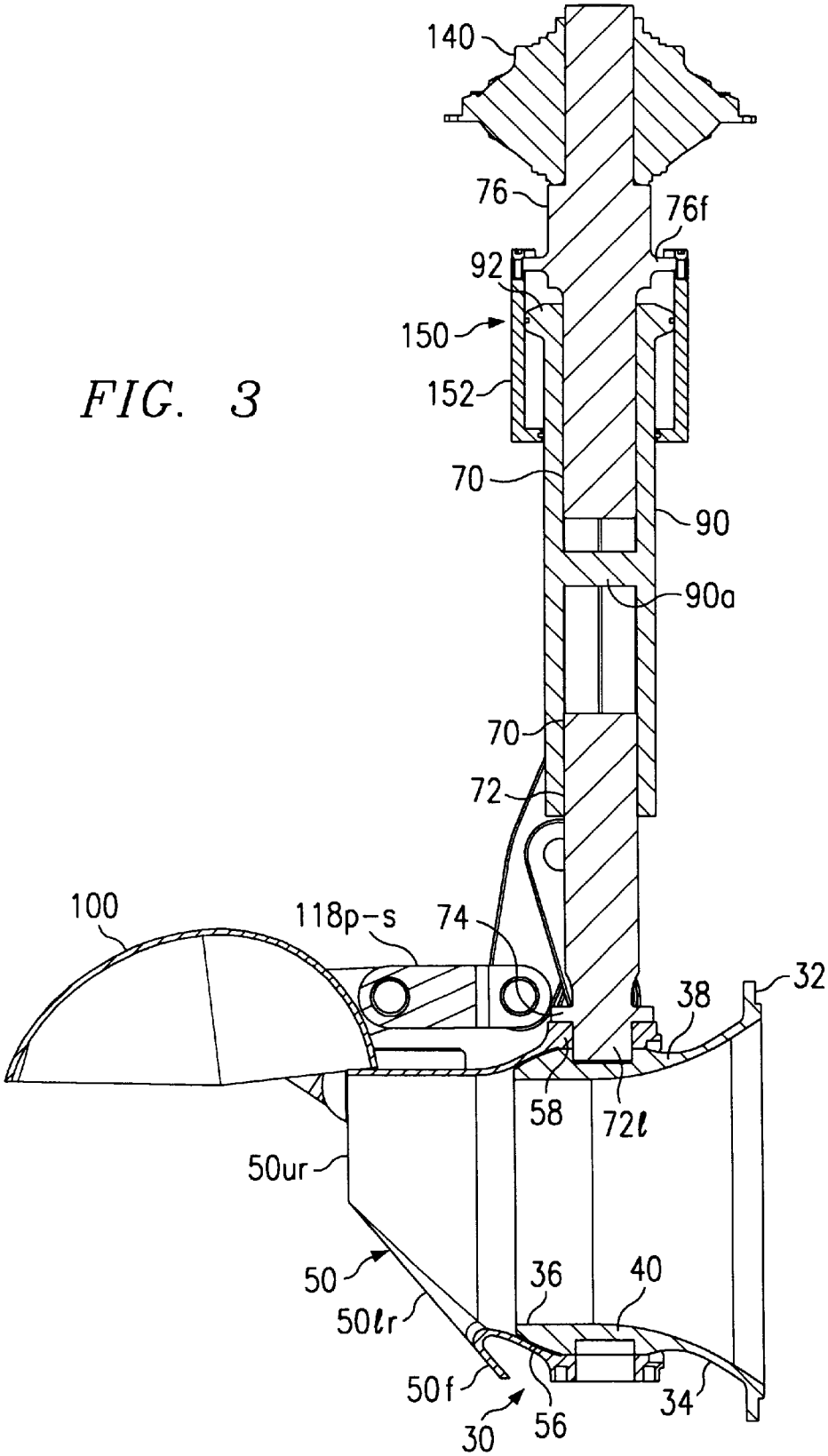
FIG. 3 is a generally schematic starboard side cross-sectional view of the first embodiment, taken along the lines 3—3 of FIG. 2.
Figure 5:
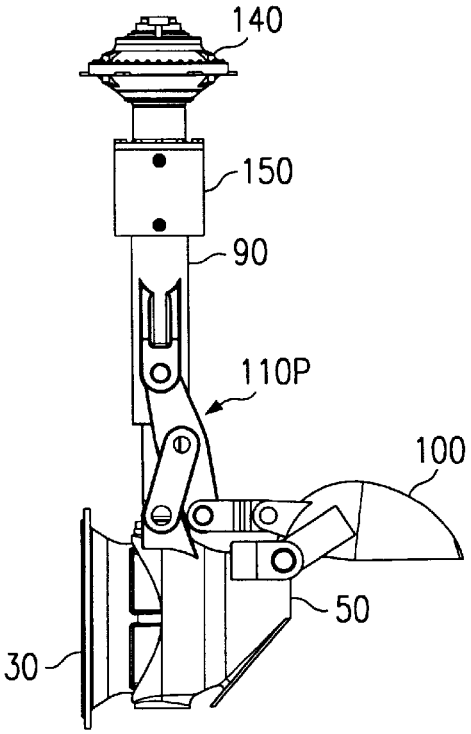
Figure 6:
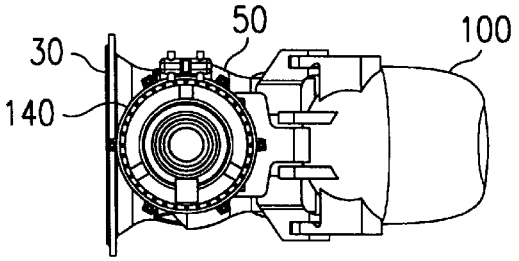
Figure 7:
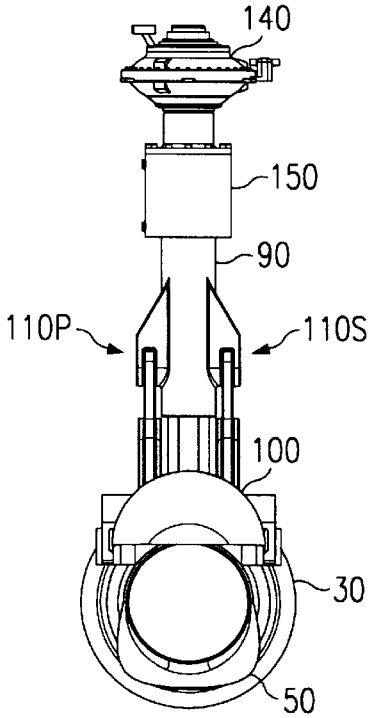
Figure 8:
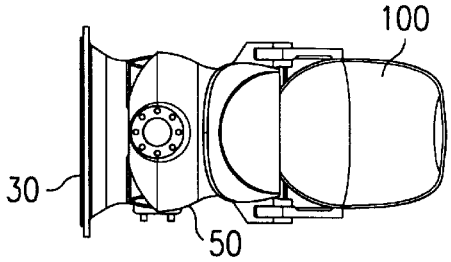
Figure 9:
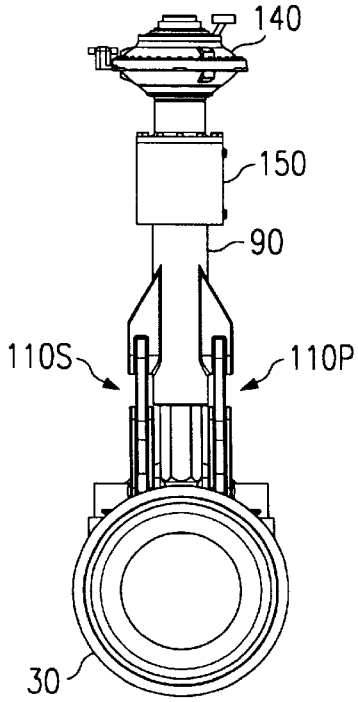
Figure 10:
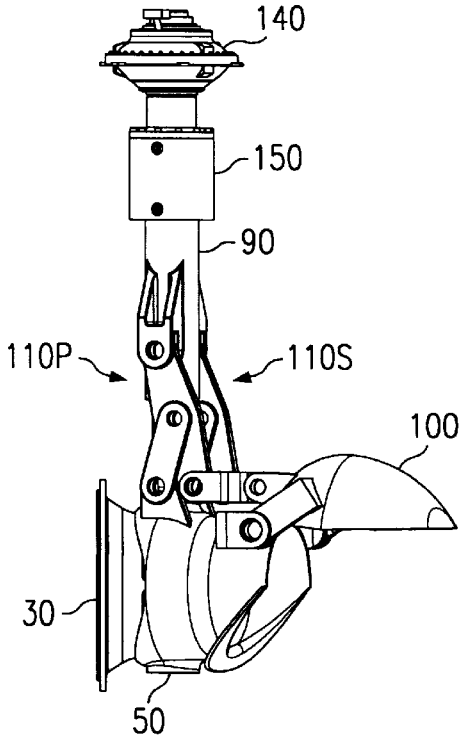
Figure 11:
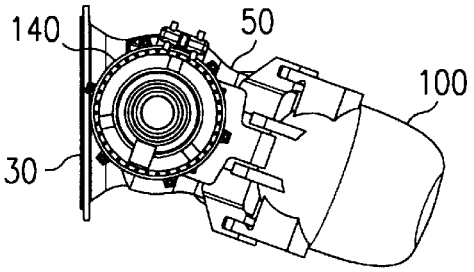
Figure 12:
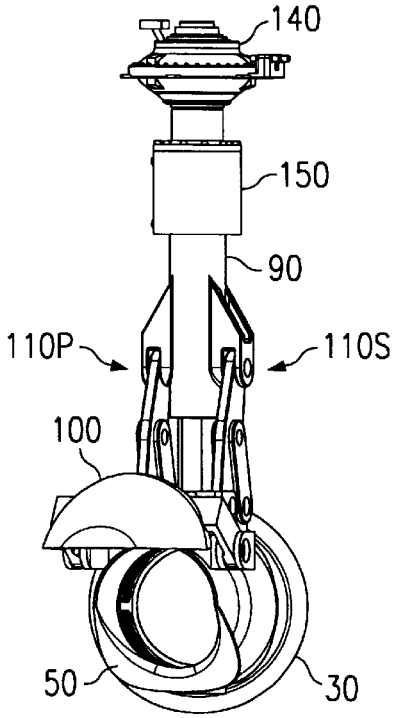
Figure 14:
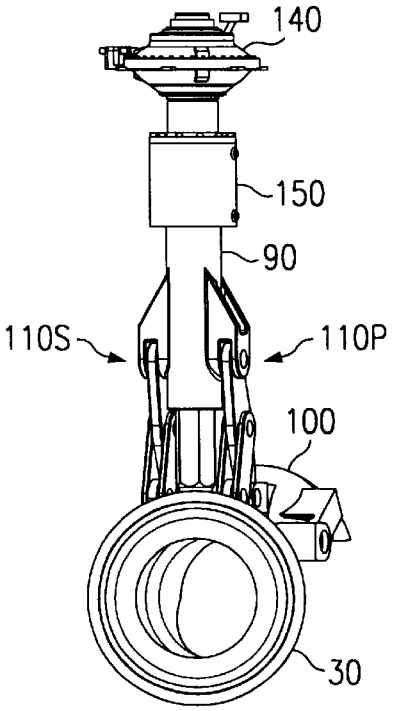
Figure 13:
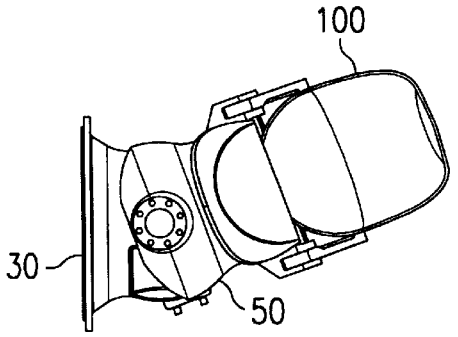
Figure 15:
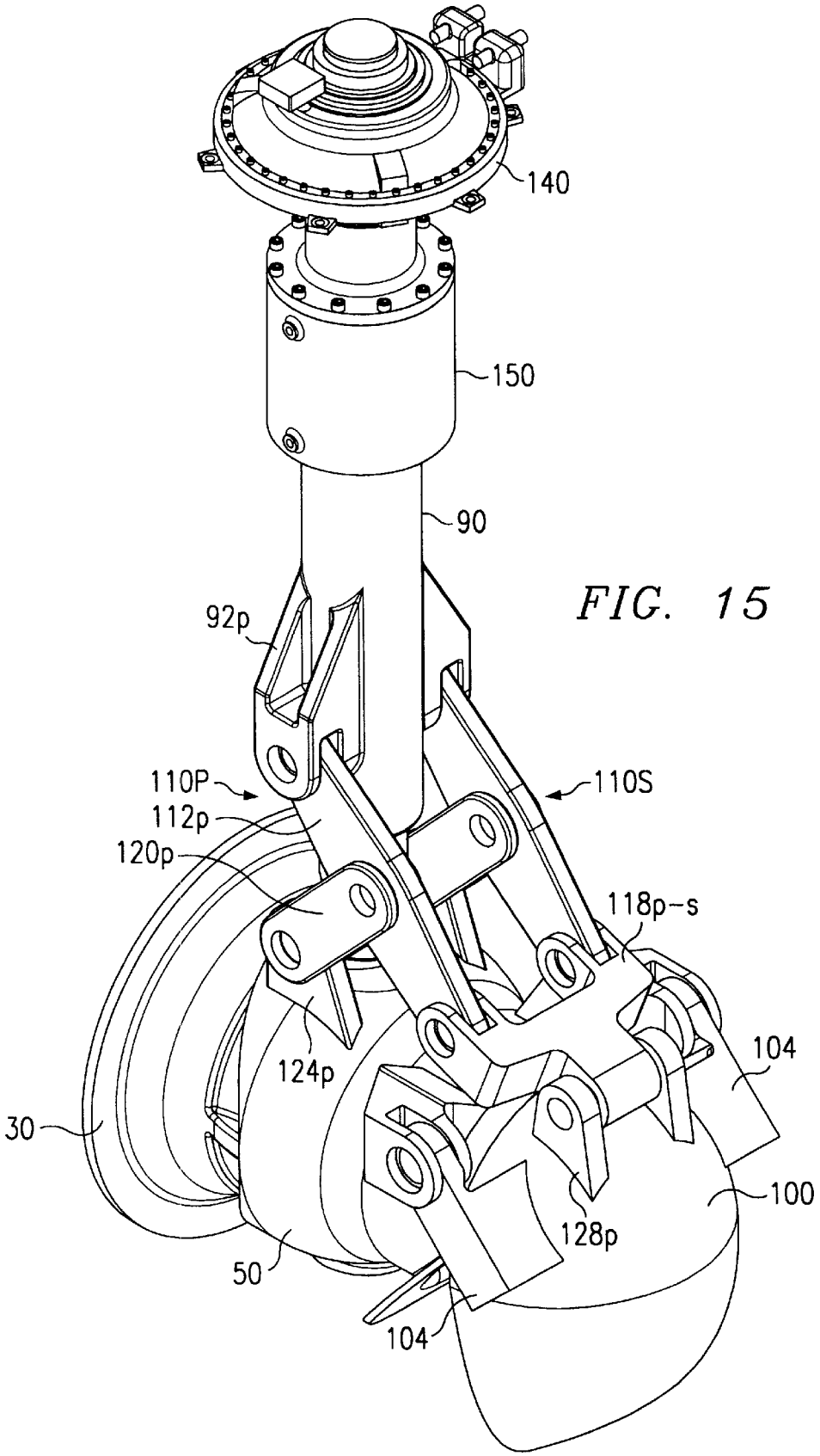
Figure 16:
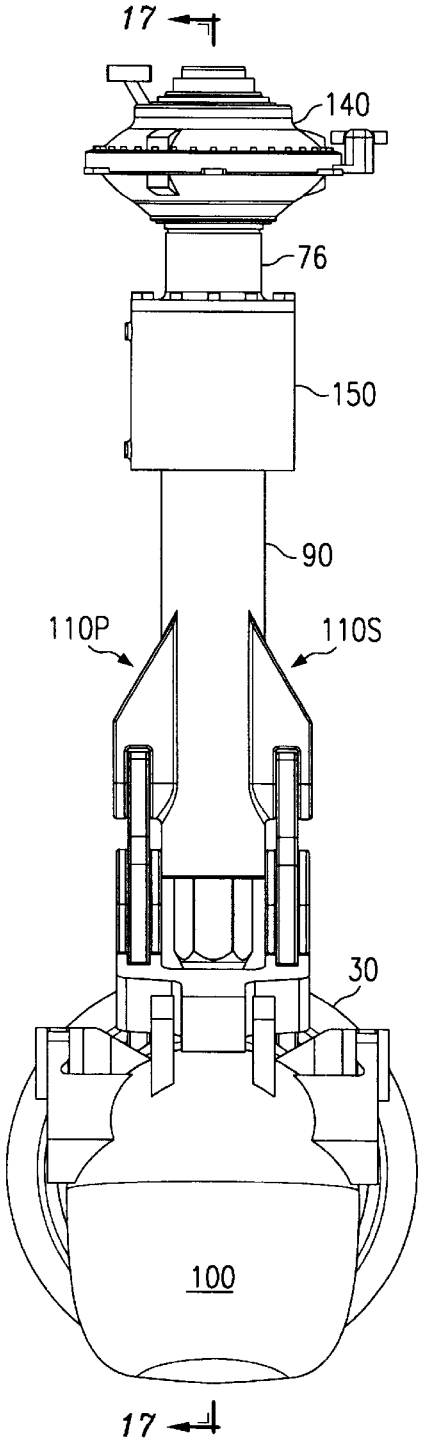
Figure 17:
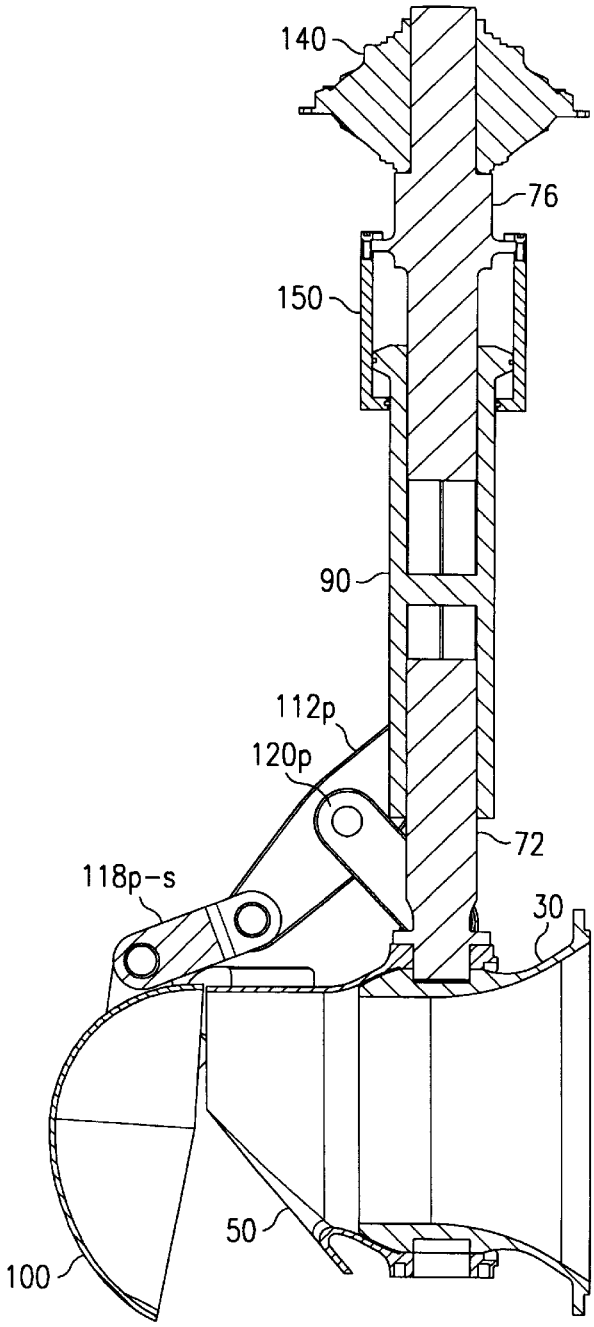
Figure 18:
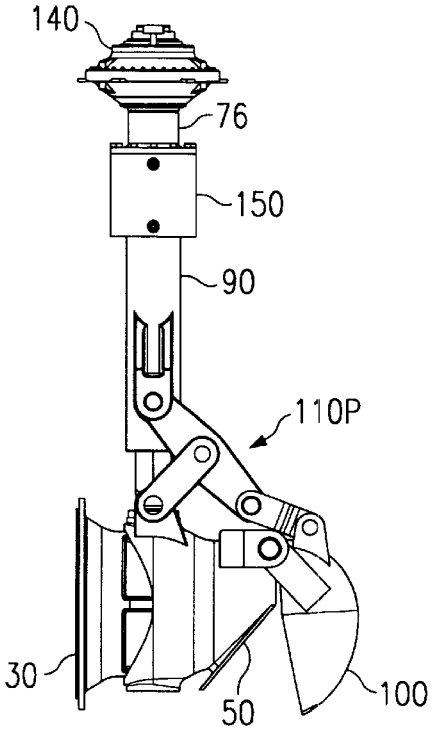
Figure 19:
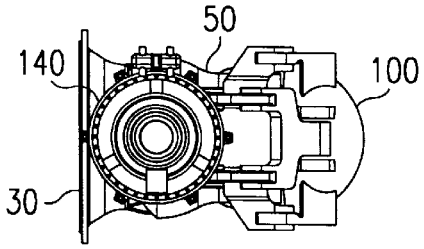
Figure 21:
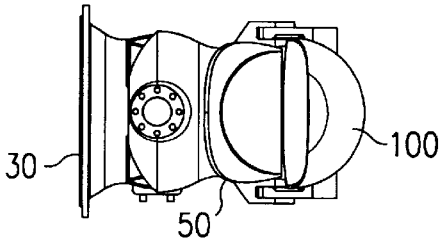
Figure 20:
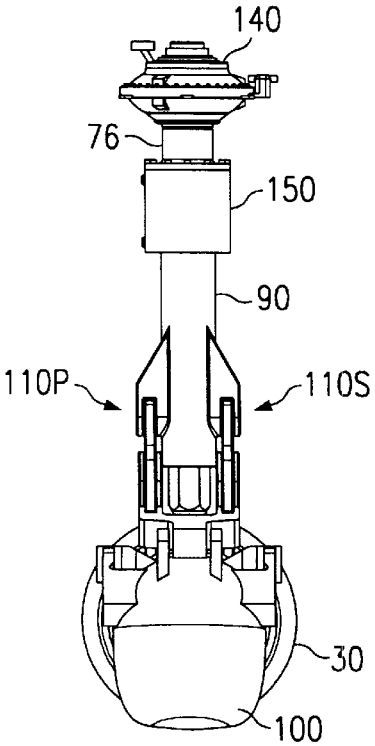
Figure 22:
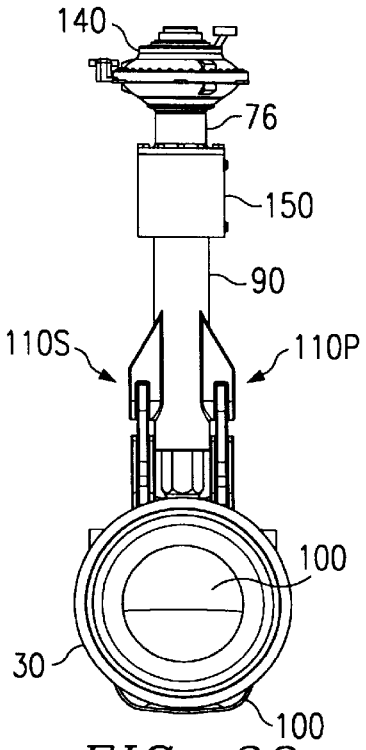
Figure 24:
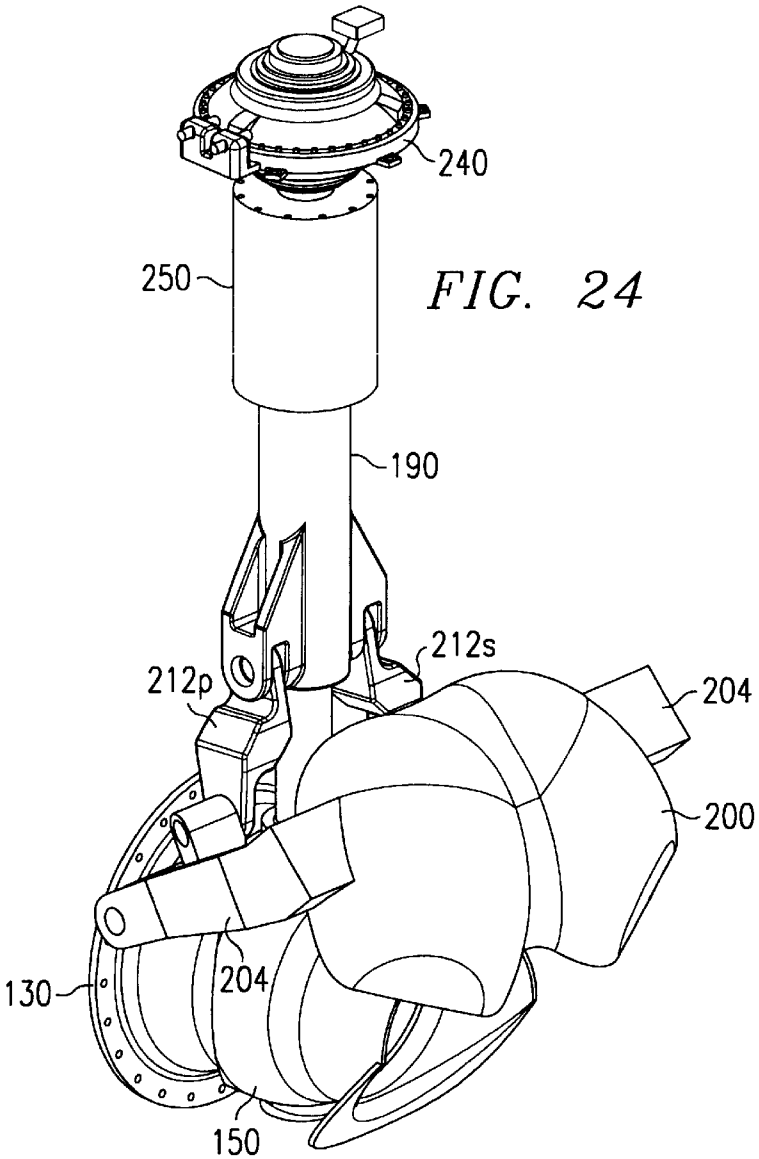
Figure 23:
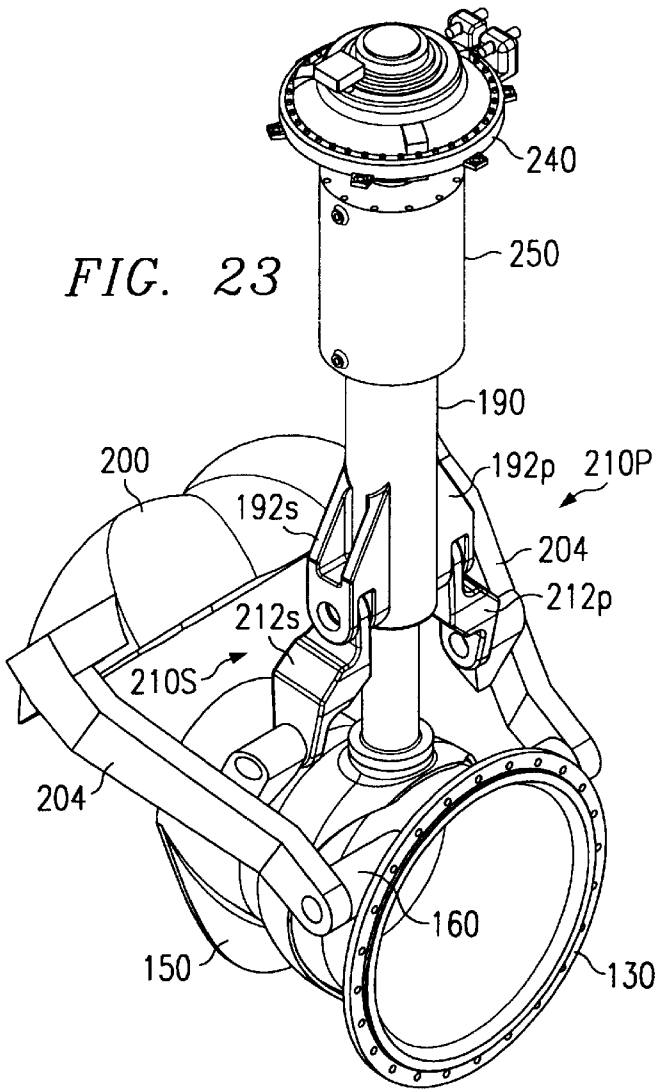
Figure 25:
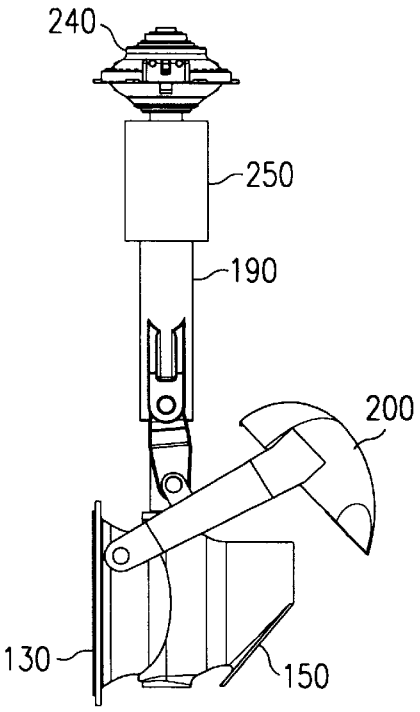
Figure 26:
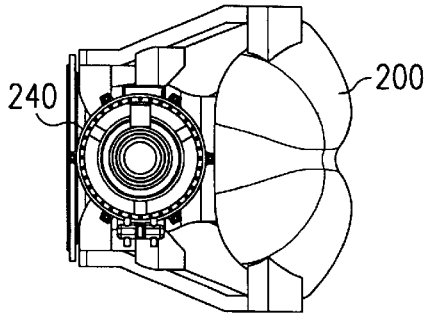
Figure 28:
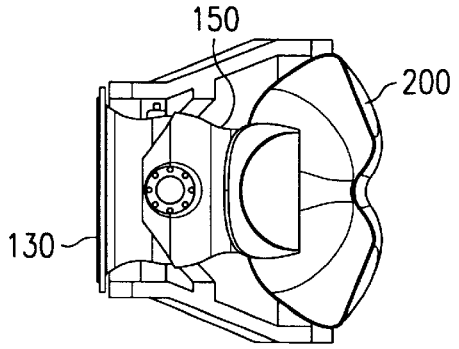
Figure 27:
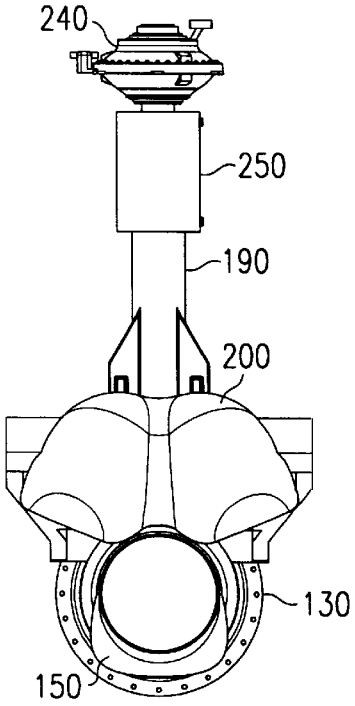

The following Figures show the first embodiment in straight-head forward mode:

FIG. 5—port side elevational;

FIG. 6—top plan;

FIG. 7—rear elevational;

FIG. 8—bottom plan;

FIG. 9—front elevational;

The following views show the first embodiment in full port ahead mode:

FIG. 10—port side elevational;

FIG. 11—top plan;

FIG. 12—rear elevational;

FIG. 13—bottom plan;

FIG. 14—front elevational;

FIGS. 15 to 17 are the same as FIGS. 1 to 3 except for showing the reversing apparatus in the operational position;

The following views show the first embodiment in the straight astern mode—reversing apparatus in the operational position:

FIG. 18—port side elevational;

FIG. 19—top plan;

FIG. 20—rear elevational;

FIG. 21—bottom plan;

FIG. 22—front elevational;

FIG. 23 is a starboard side three-quarter pictorial view of a second embodiment taken from a point of view forward of and above;

FIG. 24 is a port side three-quarter pictorial view of the second embodiment taken from a point of view aftward and above;

The following views show the second embodiment in the straight ahead mode—reversing apparatus in the inactive position:

FIG. 25—port side elevational;

FIG. 26—top plan;

FIG. 27—rear elevational;

FIG. 28—bottom plan; and

Figure 29:
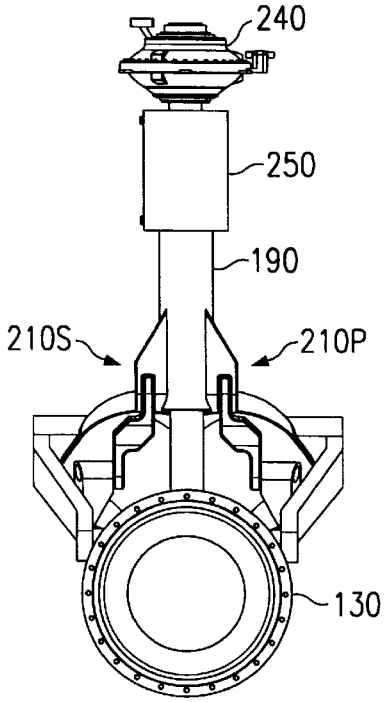

FIG. 29—front elevational.

DESCRIPTION OF THE EMBODIMENTS

Both embodiments are designed for installation at a suitable location in a vessel hull that is configured to have a generally horizontal portion lying vertically above the discharge nozzle of the waterjet pump of the ship's propulsion system. For example, the hull may have a stepped transom, a lower generally vertical portion of which has a hole for the discharge nozzle of the waterjet pump and is set back from an upper portion, thus leaving a generally horizontal, downwardly facing bottom segment. The downwardly facing bottom segment may be above the waterline in installations in which the waterjet pump discharges close to the waterline, which is the most common arrangement, or it may be well below the waterline, an arrangement which enables the pump to operate with reduced cavitation and a significant reduction in noise due to the jet. Surface vessels having waterjet pump propulsion systems in which the jets are discharged well below the waterline of the vessel are described and shown in U.S. patent application Ser. No. 09/183,455, filed Oct. 30, 1998, and entitled "SURFACE VESSEL WITH A FULLY SUBMERGED WATERJET PROPULSION SYSTEM," which is incorporated herein by reference for all purposes.

Referring to FIGS. 1 to 3, the aft portion of a discharge nozzle 30 of a waterjet pump includes a mounting flange portion 32 by which the nozzle can be bolted to a flat, substantially vertical portion of the vessel hull (not shown) around a hole through which the waterjet is expelled from the pump. The discharge nozzle 30 has a body 34 that converges smoothly toward an outlet opening 36 at the aft end.

A steering nozzle 50 is pivotally mounted on upper and lower bosses 38 and 40 of the discharge nozzle 30 for pivotal movement about an axis that lies in a vertical plane that includes the axis of the discharge nozzle 30. The nozzle discharge axis may be slightly inclined downwardly to aft. The forward portion of the steering nozzle 50 has an internal surface 56 that is spherical, with its center point lying at the intersection of the pivot axis of the steering nozzle and the axis of the discharge nozzle. The surface 56 mates in close clearance with an external complementary surface on the aft end of the discharge nozzle 30. The mating spherical surfaces allow the steering nozzle to pivot from side to side about the pivot axis of the steering nozzle while preventing significant leakage at the interface between the discharge nozzle and the steering nozzle. The body of the steering nozzle 50 is circular-cylindrical and has a upper aft edge portion 50*ur* that lies in a plane perpendicular to the discharge nozzle axis and a lower rear edge portion 501*r* that lies in a plane oblique to the discharge nozzle axis and that is bounded by a flange portion 50*f* that is coplanar with the lower rear edge portion 501*r*.

Figure 4:
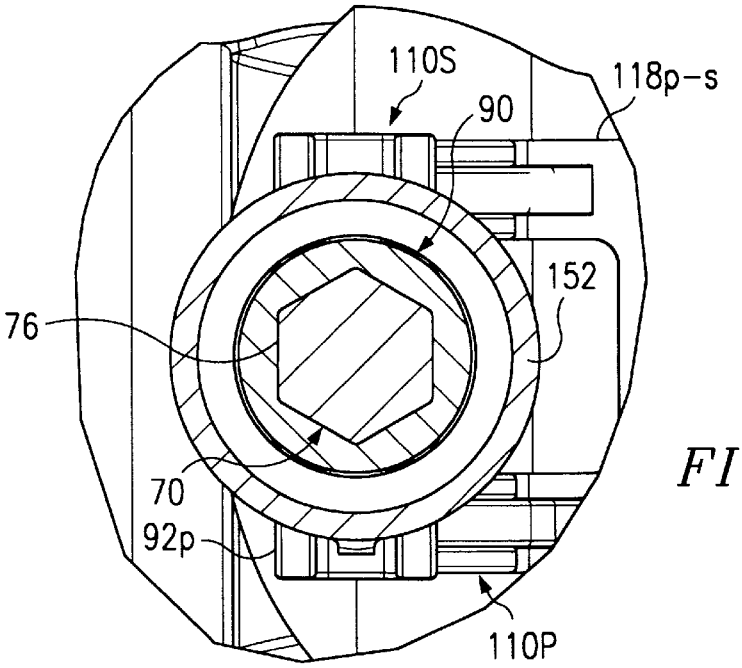
FIG. 4 is a schematic top cross-sectional view, taken along the lines 4—4 of FIG. 2.

A two-part steering shaft 70 extends upwardly coaxially with the pivot axis of the steering nozzle 50. The lower end portion 721 of a lower steering shaft part 72 serves as a pivot pin for the upper pivot mounting of the steering nozzle on the discharge nozzle and is attached to the steering nozzle by bolting a flange 74 to a boss 58 on the steering nozzle. A portion of the upper end of the lower shaft part 72 is received telescopically in the lower end portion of a tubular reversing shaft 90 (described below). The lower portion of an upper steering shaft part 76 is received telescopically in an upper portion of the reversing shaft 90. The outer surfaces of both steering shaft parts 72 and 76 are configured to prevent rotation of the steering shaft parts relative to the reversing shaft about the steering shaft axis while permitting the steering shaft to translate axially relative to the steering shaft. In the embodiment of FIGS. 1 to 22, as shown in FIG. 4, the steering shaft parts 72 and 76 are of hexagonal cross-section and mate in sliding relationship with complementary internal surfaces of hexagonal shape in cross-section of the reversing shaft 90. Other arrangements for coupling the steering shaft parts 72 and 76 to the reversing shaft 90 for conjoint rotation while allowing the reversing shaft to translate axially relative to the steering shaft parts include a sliding key, a sliding spline, a sliding square, and the like.

A reversing deflector 100 having a body 102 of generally cup-like shape is mounted on the aft portion of the steering nozzle 50 for pivotal movement about a horizontal axis by reception of a pair of arm portions 104 in bifurcated mounting bosses 60 affixed to the steering nozzle and pivot pins 106 received in holes in the arm portions 104 and the bosses 60. The pivot axis of the reversing deflector 100 is located near the aft end of the steering nozzle 50 and above the center axis of the steering nozzle.

The reversing deflector 100 is mechanically linked to the reversing shaft 90 by a pair of mechanical linkages 110P and 110S that are located and constructed symmetrically with respect to the steering shaft axis. Each linkage 110P and 110S consists of a Scott-Rouselle mechanism coupled to the reversing shaft 90 and having a pivot output and a reversed crank-slider mechanism coupled to the reversing deflector 100 and a pivot input coupled to the pivot output of the Scott-Rouselle mechanism. The port Scott-Rouselle mechanism consists of the following components:

A link 112*p* that is pivotally coupled by a pivot pin 114*p* at its upper end to a fixed pivot mounting arm 92*p* on the reversing shaft 90 and is pivotally coupled at its lower output end by an input pivot pin 116*p* to a link 118*p–s* of the reversed crank-slider mechanism (the link 118*p–s* is a single Y-shaped member shared by the port and starboard linkages); and A pair of links 120*p*, one on each side of the link 112*p*, each of which is pivotally coupled by a pivot pin 122*p* to a fixed mounting arm 124*p* on the steering nozzle 50 and is pivotally coupled at its upper end by a pivot pin 126*p* to the link 112*p*.

The port reversed crank-slider mechanism consists of:

The link 118*p–s*; and

The rigid mechanical coupling between the port mounting boss 60—by the arm 104 and the reversing deflector body 102—and an arm 128*p* affixed to the steering deflector 100 and coupled by a pivot pin 130*p* to the link 118*p–s*.

The steering shaft 70 and the reversing shaft 90 are driven conjointly in rotation about the steering pivot axis by a suitable rotary drive apparatus 140, various types of which can be used, as mentioned above. The embodiment has a vane-type hydraulic rotary actuator as the rotary drive apparatus 140. When rotated, the output of the rotary drive 140 rotates the upper shaft part 76, which transmits rotational torque to the reversing shaft 90 through the sliding hex coupling (see FIG. 4). The reversing shaft transmits torque through the hex coupling to the lower steering shaft part 72, which by virtue of the affixation of the flange portion 74 of the lower steering shaft part 72 to the steering nozzle 50 and affixation of the reversing deflector by the pivot couplings 60, 106 to the steering nozzle rotates both the steering nozzle and the reversing deflector about the steering axis (more accurately, the common axis of the steering shaft 70 and the reversing shaft 90). Rotation of the steering nozzle deflects the jet so that it exits from the steering and reversing apparatus with a lateral thrust component. FIGS. 10 to 14 show the apparatus rotated to port, thus to turn the vessel to port.

A suitable axial drive device 150, examples of which are referred to above, is coupled between the upper steering shaft part 76 and the reversing shaft 90 and when actuated translates the reversing shaft up or down relative to the steering shaft. In the embodiment, the axial drive device is a double-acting piston/cylinder, which consists of an annular piston portion 92 at the upper end of the reversing shaft 90 and a cylinder 152, which is bolted at its upper end to a flange 76*f* on the upper steering shaft part 76 and is sealed in sliding relation at its lower end to the reversing shaft. Hydraulic fluid is supplied to or discharged from the respective working chambers of the piston/cylinder axial drive 150 through cylinder ports 154 and 156.

In an upper position of the reversing shaft 90 (see FIGS. 1 to 3 and 5 to 9), the reversing deflector is retained in an inactive position above the water jet that emerges from the steering nozzle, thus enabling ahead propulsion of the vessel. Axial translation downwardly of the reversing shaft 90 from the position shown in FIGS. 1 to 3 and 5 to 9 pivots the reversing deflector 100 downwardly so that the water jet exiting the steering nozzle is intercepted and deflected so that has a forward component, thus enabling reverse propulsion of the vessel. FIGS. 15 to 22 show the steering and reversing apparatus in the reverse propulsion mode. In the reverse propulsion mode with the steering deflector in the active downward position, the steering nozzle can be rotated by the rotary drive 140, thus to provide reverse steering.

The second embodiment, which is shown in FIGS. 23 to 29, is for the most part the same as the first part. The reference numerals for the corresponding parts of the second embodiment are the same as those of the first embodiment, but increased by 100.

Instead of having the reversing deflector pivotally mounted on the steering nozzle, the reversing deflector 200 is mounted on pivot mounting bosses 160 affixed to the pump discharge nozzle 130 by arms 204. The pivot axis of the reversing deflector 200 is located well forward of the aft single link 212*p*, 212*s* pivotally coupled at one end to a mounting arm 192*p*, 192*s* on the reversing shaft and pivotally coupled at the other end to a respective arm 204, to be provided to couple the reversing shaft 190 to the reversing deflector 200. Another difference between the first and second embodiments, which the drawings do not show, is that the reversing shaft is not rotatable with the steering shaft. The reversing deflector 200 is shaped to deflect the waterjet in a direction having a forward component and a lateral component that varies as a function of the rotational position of the steering nozzle, thus to permit steering in the reverse direction of propulsion.

As previously mentioned, steering and reversing apparatus embodying the present invention is mounted in a portion of a vessel hull that overlies the outlet of the discharge nozzle, thereby permitting the rotary drive device 140 (240) for the steering shaft 70 (170) and the axial d rive 150 (250) for the reversing shaft 90 (190) to be located within the hull. The portion of the reversing shaft below the cylinder 154 (254) and above the pivot mounting arms 92*p* (192*p*) passes through a suitable seal installed in an opening in the hull.

What is claimed is:

1. Steering and reversing apparatus for a waterjet propulsion system having a waterjet propulsion pump that includes a discharge nozzle having at least an aft portion located outboard of a vessel hull, comprising a steering nozzle adapted to be mounted aft of the discharge nozzle for pivotal movement about a steering pivot axis that lies in a substantially vertical plane that includes the axis of the discharge nozzle of the pump, a reversing deflector adapted to be mounted for pivotal movement about a reversing pivot axis for movement between an inactive position substantially clear of a water jet discharged from the steering nozzle and an operative position in which the water jet impinges on a surface of the reversing deflector that is configured to reverse the direction of the water jet to a direction having a forward vector, the reversing pivot axis being perpendicular to the vertical plane and spaced apart from the steering pivot axis, a rotatable steering shaft that is coupled at its lower end to the steering nozzle, is coaxial with the steering pivot axis, is adapted to extend upwardly through an opening in the hull, and has an upper end portion adapted to be located within the hull, a hollow reversing shaft that is received telescopically over a portion of the steering shaft and is translatable axially relative to the steering shaft, a rotary drive apparatus adapted to be received within the vessel hull and coupled to the upper end portion of the steering shaft for imparting rotation to the steering shaft, a mechanical linkage coupled between the reversing shaft and the reversing deflector and operative to pivot the reversing deflector between the inactive position and the operative position in response to axial translation of the reversing shaft, and an axial drive device coupled between the steering shaft and the reversing shaft and operative to translate the reversing shaft axially of the steering shaft.

2. The steering and reversing apparatus according to claim 1 wherein the steering nozzle is adapted to be pivotally mounted on the discharge nozzle.

3. The steering and reversing apparatus according to claim 1 wherein the steering shaft has an upper steering shaft part having a lower end portion received telescopically in an upper portion of the reversing shaft and a lower shaft part having an upper portion received telescopically in a lower portion of the reversing shaft.

4. The steering and reversing apparatus according to claim 1 wherein the linkage includes a Scott-Russell mechanism coupled to the reversing shaft and having a pivot output and a reversed crank-slider mechanism coupled to the reversing deflector and a pivot input coupled to the pivot output of the Scott-Russell mechanism.

5. The steering and reversing apparatus according to claim 1 wherein the rotary drive apparatus is a rotary hydraulic actuator.

6. The steering and reversing apparatus according to claim 1 wherein the axial drive device is a piston/cylinder.

7. The steering and reversing apparatus according to claim 1 wherein the linkage includes a pair of Scott-Russell mechanisms coupled to the reversing shaft, each having a pivot output, and a pair of reversed crank-slider mechanisms coupled to the reversing deflector, each reversed crank-slider mechanism including a pivot input coupled to the pivot output of one of the Scott-Russell mechanisms, each pair of mechanisms being symmetrically located and configured with respect to the vertical plane.

8. The steering and reversing apparatus according to claim 1 wherein the reversing deflector is pivotally mounted on the steering nozzle for rotation therewith about the steering axis and the reversing shaft is coupled to the steering shaft for conjoint rotation therewith.

9. The steering and reversing apparatus according to claim 1 wherein the reversing deflector is pivotally mounted independently of the steering nozzle for rotation about a fixed horizontal axis perpendicular to the vertical plane and is shaped to deflect the water jet in a direction having a forward component and to have a lateral component that varies as a function of rotational positions of the steering nozzle.

* * * * *